US012624297B1

(12) United States Patent
Schweitzer et al.

(10) Patent No.: US 12,624,297 B1
(45) Date of Patent: May 12, 2026

(54) REMOVAL OF HYDROGEN SULFIDE AND/OR MERCAPTANS FROM OIL OR OIL DERIVATIVES AND TREATMENT COMPOSITIONS FOR ACCOMPLISHING THE SAME

(71) Applicant: Ripcord Energy Solutions, LLC, Savannah, GA (US)

(72) Inventors: Linda Esther Schweitzer, Rochester Hills, MI (US); Bobby Burkes, Sr., New Orleans, LA (US)

(73) Assignee: Ripcord Energy Solutions, LLC, Savannah, GA (US)

( * ) Notice: Subject to any disclaimer, the term of this patent is extended or adjusted under 35 U.S.C. 154(b) by 114 days.

(21) Appl. No.: 18/630,138

(22) Filed: Apr. 9, 2024

Related U.S. Application Data

(63) Continuation of application No. 18/355,592, filed on Jul. 20, 2023, now Pat. No. 11,952,537.

(60) Provisional application No. 63/369,088, filed on Jul. 22, 2022.

(51) Int. Cl.
*C10G 17/09* (2006.01)

(52) U.S. Cl.
CPC ..... *C10G 17/09* (2013.01); *C10G 2300/202* (2013.01)

(58) Field of Classification Search
CPC .... C10G 17/09; C10G 2300/202; C10L 3/103
See application file for complete search history.

(56) References Cited

U.S. PATENT DOCUMENTS

| | | | | |
|---|---|---|---|---|
| 2018/0105486 | A1 | 4/2018 | Stamm et al. | |
| 2019/0211271 | A1 | 7/2019 | Medoff et al. | |
| 2020/0148961 | A1 | 5/2020 | Martin et al. | |
| 2022/0356407 | A1 * | 11/2022 | Roe | C10G 29/10 |

FOREIGN PATENT DOCUMENTS

| | | | | |
|---|---|---|---|---|
| CA | 2907896 | A1 * | 10/2014 | G01N 33/0044 |
| CN | 1724162 | A | 1/2006 | |
| FR | 913349 | A | 9/1946 | |
| WO | 2010080428 | A1 | 7/2010 | |

OTHER PUBLICATIONS

English Translation of Chinese Office Action, Application No. 202380064250.9, Jul. 5, 2025, 8 pages.
English Translation of Korean Office Action, Application No. 10-2025-7005521, Apr. 18, 2025, 7 pages.
Examination Report from Kuwait Patent Office, Application No. KW/P/2025/000731, Aug. 6, 2025 , 11 pages.

* cited by examiner

*Primary Examiner* — Prem C Singh
*Assistant Examiner* — Juan C Valencia
(74) *Attorney, Agent, or Firm* — FisherBroyles, LLP; Susan M. Oiler

(57) ABSTRACT

Aqueous treatment compositions for crude oil and/or petroleum distillates to remove sulfur compounds therefrom and treatment methods using such compositions are disclosed. The composition has less than 0.5% wt/wt di- or tri-benzohydroxy compound, a strong base, less than 1% wt/wt divalent metal gluconate, a balance of water, and a pH that is 9 or greater. The treatment method includes adding said treatment composition to crude oil or a petroleum distillate to form a mixture having 0.001% to 0.02% wt di- or tri-benzohydroxy compound/wt oil and 0.001% to 0.03% wt divalent metal gluconate/wt oil and mixing the same together.

18 Claims, 1 Drawing Sheet

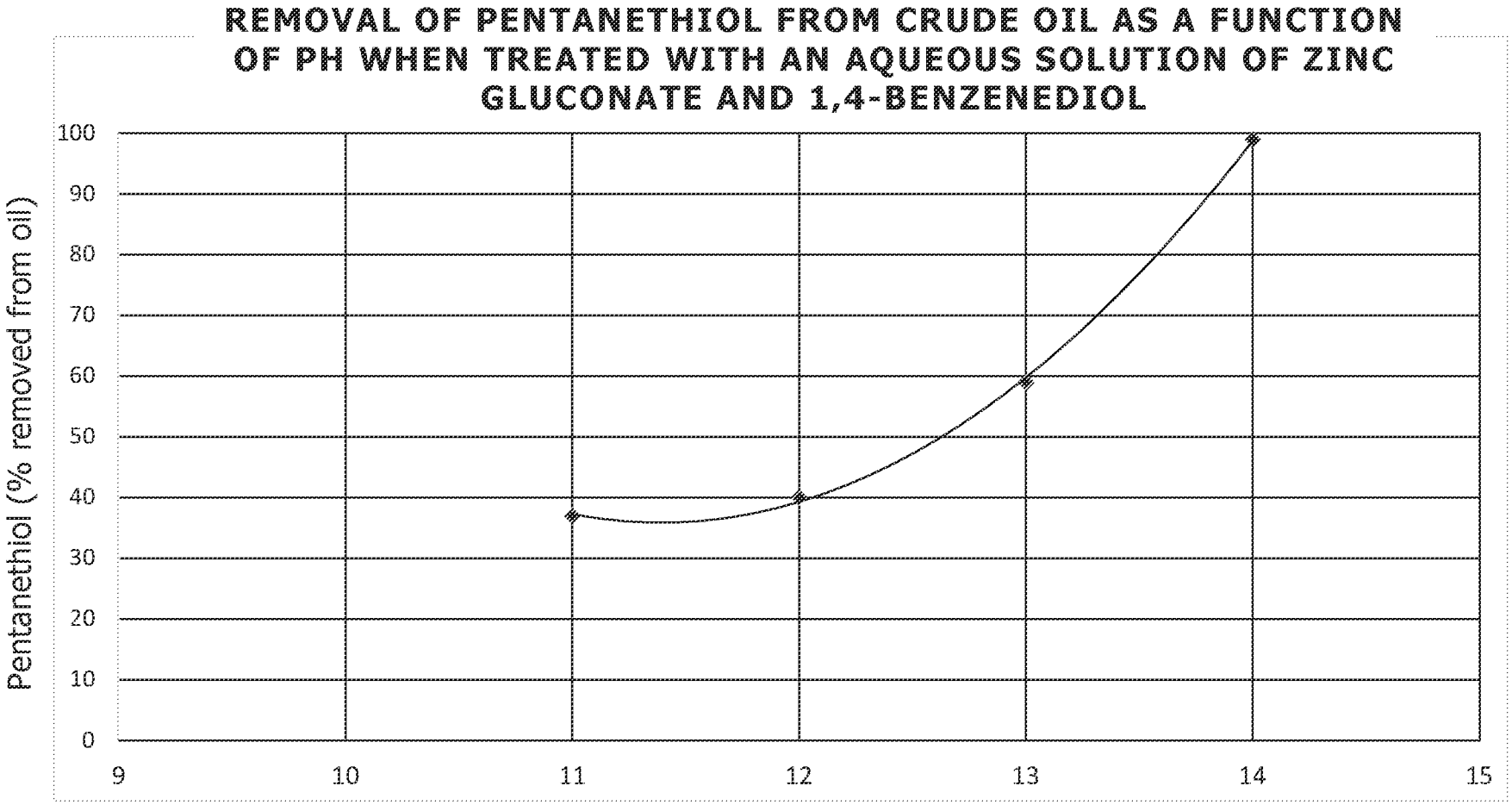
REMOVAL OF PENTANETHIOL FROM CRUDE OIL AS A FUNCTION OF PH WHEN TREATED WITH AN AQUEOUS SOLUTION OF ZINC GLUCONATE AND 1,4-BENZENEDIOL
Pentanethiol (% removed from oil)
100
90
80
70
60
50
40
30
20
10
0
9
10
11
12
13
14
15
pH

REMOVAL OF HYDROGEN SULFIDE AND/OR MERCAPTANS FROM OIL OR OIL DERIVATIVES AND TREATMENT COMPOSITIONS FOR ACCOMPLISHING THE SAME

RELATED APPLICATIONS

This application is a continuation of U.S. application Ser. No. 18/355,592, filed Jul. 20, 2023, which claims the benefit of U.S. Provisional Application 63/369,088, filed Jul. 22, 2022, the entirety of which is incorporated herein by reference.

TECHNICAL FIELD

The present application relates the removal of hydrogen sulfide and/or mercaptans from oil, more particularly, from crude oil and/or petroleum distillates by an oxidation reaction caused by treatment with a caustic solution of a divalent metal gluconate and a di- or tri-benzohydroxy compound.

BACKGROUND

Removal of hydrogen sulfide from oils has been a long-standing problem as evidenced by U.S. Pat. No. 2,468,701 filed Jan. 25, 1945, which is still an unresolved need as evidenced by U.S. Pat. Nos. 4,206,194; 5,180,572; and 6,746,611. Along with hydrogen sulfide, it is desirable to remove mercaptans as well. Both are volatile toxic gases often present in crude oil. Crude oil that has a high sulfur content can lead to corrosion, catalyst poisoning, and environmental pollution. If the sulfur content remains, it can be present in gasoline, diesel fuel, and jet fuel, which is undesirable.

Numerous sulfur compounds can be present in the crude oil. Here is a list of sulfur compounds in order of increasing difficulty of removal from crude oil: disulfides (R—S—S—R); sulfides (R—S—R); thiols (R—$CHCH_3$)—$CH_2$—SH); thiophenol (Phe-SH); diphenyl sulfide (Phe-S-Phe); thiophen ($C_4H_4S$) or dibenzothiophene ($C_{12}H_8S$).

A common treatment process for crude oil is caustic washing. Caustic washing removes sulfides from crude oil and petroleum distillates. While this method is relatively simple and cost effective, it does not remove all sulfur forms therefrom, especially organic sulfides and it results in large quantity of caustic soda (NaOH/KOH) wastewater that is an environmental hazard. The wastewater is typically collected in large ponds for post-treatment. Such post-treatments are costly and time consuming.

Furthermore, the oil will be imparted with sodium, and residual alkalinity, which can make the oil corrosive and can cause scaling problems in pipelines and other infrastructure. Moreover, at high pH, the presence of sulfide ions can cause reactions with metals. Caustic washing can also cause a water-in-oil emulsion and foam from saponification of fatty acids in the oil.

Others have tried dry gas desulfurization, hydrodesulfurization, and bio-desulfurization, which are much more expensive methods. Triazine and other amines are commonly used liquid scavengers that strip hydrogen sulfide out of oil, but residual triazine in oil can cause fouling and corrosion of pipes, towers, and other equipment.

While these methods have been shown to reduce hydrogen sulfide in oil, there is always a need to find a more cost effective, more environmentally friendly process that is also faster and more effective at removing sulfur compounds from crude oil and petroleum distillates, including removal of mercaptans, not just hydrogen sulfide.

SUMMARY

In a first aspect, methods of treating crude oil or petroleum distillates are disclosed. The methods include providing a crude oil or petroleum distillate in need of a reduced content of sulfur containing compounds and adding a treatment composition thereto. The treatment composition has a pH of 9 or greater and comprises:

(a) less than 1% wt/wt di- or tri-benzohydroxy compound;

(b) a strong base;

(c) less than 0.5% wt/wt divalent metal gluconate; and (d) a balance of water.

The method also includes mixing the treatment composition and the crude oil or petroleum distillate to form a mixture comprising 0.001% to 0.02% wt (a)/wt oil and 0.001% to 0.03% wt (c)/wt oil. Upon mixing (a) in the presence of (c) oxidizes a sulfur compound in the crude oil or petroleum distillate, thereby reducing the amount thereof in the crude oil or petroleum distillate. During the adding and mixing oxygen gas can be introduced. The oxygen gas source can be ambient air. The method can optionally include adding 1000 ppm or less of a 30% wt/wt hydrogen peroxide aqueous solution after mixing the treatment composition with the crude oil or petroleum distillate and washing the mixture with toluene, ozonated water, or a hydrogen peroxide solution after the reduction in the amount of sulfur compounds present. Alternately, the method can include adding 1000 ppm or less of polyethylene glycol after mixing the treatment composition with the crude oil or petroleum distillate.

Typically, the sulfur compound is hydrogen sulfide and/or a mercaptan. In one embodiment, (a) is present as less than 0.2% wt/wt of the treatment composition and (a) is hydroquinone and/or pyrogallol, more preferably hydroquinone and pyrogallol. The wt/wt concentration of pyrogallol is greater than the wt/wt concentration of hydroquinone.

In one embodiment, the pH is at least 13. In one embodiment, (c) comprises zinc gluconate and/or magnesium gluconate, more preferably a mixture of zinc gluconate and magnesium gluconate. The mixing can be performed for at least one hour, more preferably at least two hours.

In another aspect, treatment compositions for crude oil and/or petroleum distillates are disclosed. The treatment compositions include:

(a) less than 0.5% wt/wt di- or tri-benzohydroxy compound, more preferably less than 0.2% wt/wt;

(b) a strong base;

(c) less than 1% wt/wt divalent metal gluconate; and (d) balance water;

wherein the treatment composition has a pH of 9 or greater, more preferably 13 or greater. In one embodiment, (a) is hydroquinone and/or pyrogallol, more preferably a mixture of hydroquinone and pyrogallol. For the mixture of hydroquinone and pyrogallol, the wt/wt concentration of hydroquinone can be greater than the wt/wt concentration of pyrogallol. (c) is zinc gluconate and/or magnesium gluconate, more preferably a mixture of zinc gluconate and magnesium gluconate.

In another aspect, treatment compositions for crude oil and/or petroleum distillates are disclosed that have (a) less than 1% wt/wt di- or tri-benzohydroxy compound;

(b) a strong base;

(c) less than 1% wt/wt metallic zinc powder; and (d) balance water;

wherein the treatment composition has a pH of 9 or greater.

BRIEF DESCRIPTION OF THE DRAWINGS

The FIGURE is a graph of the removal by an oxidation reaction of pentanethiol (starting at 100 ppm) in oil when treated with an aqueous treatment composition as a function of pH.

DETAILED DESCRIPTION

The following detailed description will illustrate the general principles of the invention, examples of which are additionally provided in the accompanying drawings.

As used herein, percent or the percent symbol, is understood to mean a percent by weight of the total composition unless expressly stated otherwise. It should also be noted that in specifying any range of concentration or amount, any particular upper concentration or amount can be associated with any particular lower concentration or amount.

Except in the working examples, or where otherwise explicitly indicated, all numbers in this description indicating amounts, parts, percentages, ratios, and proportions of material, physical properties of material, and conditions of reaction are to be understood as modified by the word "about." "About" as used herein means that a value is preferably +/−5% or more preferably +/−2% thereof.

As used herein, "room temperature" means 25° C.+/−5° C., more preferably +/−2° C.

In a first aspect, treatment compositions for crude oil or petroleum distillates that oxidize certain sulfur compounds therein are described. Post-oxidation, the oxidized sulfur compounds can be removed by extraction or washing if desired. Petroleum distillates, also known as horticulture oils, are separated from crude oil for many industrial uses. Mineral oil, naphtha, heavy fuel oil, waxes, and benzene are example distillates. The treatment composition reduces the presence of sulfur compounds by an oxidation mechanism therewith. More particularly sulfur compounds such as hydrogen sulfide and mercaptans are, via the oxidation mechanism, converted to thiosulfates and disulfides, and possibly polysulfide. The treatment composition has a pH of 9 or greater and includes as a weight percent of the composition:

(a) less than 0.5% wt/wt di- or tri-benzohydroxy compound;

(b) a strong base in an amount that provides the pH of 9 or greater;

(c) less than 1% wt/wt divalent metal gluconate; and (d) balance water.

The pH is more preferably 11 or greater, 12 or greater, 13 or greater. By having a pH at or greater than 11.5, the pH is at or above the second pKa for hydrogen sulfide. The pH is controlled by the strong base. The strong base can be NaOH and/or KOH. In one embodiment, the strong base is a mixture of NaOH (50% solution) and KOH (40% solution) in about a 1:1 ratio by % wt/wt. For example, NaOH is commercially available in its concentrated form as 50% wt/wt in water and KOH is commercially available in its concentrated form as either 40% or 45% wt/wt in water, and a blend thereof at a ratio of 1:1 would be a mixture of 100 ml concentrated NaOH to 100 ml of concentrated KOH, or IL to IL, etc. In another embodiment, the ratio is 1.1:1, or more preferably 1.09:1. In yet another embodiment, the ratio is 1.5:1, 2:1, or 3:1. The ratio is typically selected to balance overall properties of the treatment solution, including, but not limited to viscosity, density, and a balance of cation concentrations for enhanced solubility of end products.

The di- or tri-benzohydroxy compound is more preferably present as less than 0.4% wt/wt, or less than 0.3% wt/wt, and even more preferable less than 0.2% wt/wt of the treatment composition. The di- or tri-benzohydroxy compound is selected from the group consisting of hydroquinone (1,4-dibenzendiol), pyrogallol (1,2,3-trihydroxybenzene), gallic acid (3,4,5-trihydroxybenzoic acid), and 1,2,4-benzenetriol and combinations thereof. In one embodiment, the di- or tri-benzohydroxy compound is a mixture of hydroquinone and pyrogallol, and the wt/wt concentration of pyrogallol is greater than the wt/wt concentration of hydroquinone. The wt/wt percentage of pyrogallol can be a factor of 500 times greater that for hydroquinone, for example, pyrogallol as 0.1% wt/wt to hydroquinone as 0.0002% wt/wt. Pyrogallol is an oxygen scavenger. As such, pyrogallol can bring oxygen gas from the headspace in a reaction vessel into the crude oil or petroleum distillate to participate in the oxidation mechanism of the reaction. The profile of the oil by gas chromatography and mass spectrometer analysis shows no change in the composition of the hydrocarbons in the oil. The introduction of a small amount of oxygen from air into the oil can be effective in "sweetening" the oil (i.e., via oxidation of mercaptans and hydrogen sulfide) but is not strong enough to oxidize the oil. In some cases, however, there was a reduction in the asphaltene content.

The divalent metal gluconate is more preferably present as less than 0.8% wt/wt, or less than 7% wt/wt, and even more preferably less than 6% wt/wt of the treatment composition. The divalent metal gluconate is selected from the group consisting of zinc gluconate, magnesium gluconate, calcium gluconate, iron (II) gluconate, copper (II) gluconate and combinations thereof. In one embodiment, the divalent metal gluconate is a mixture of zinc gluconate and magnesium gluconate. In one embodiment, the wt/wt concentration of the zinc gluconate is greater than the wt/wt concentration of the magnesium gluconate. The wt/wt percentage of zinc gluconate can be a factor of 10 times greater that for the magnesium gluconate, for example, zinc gluconate as 0.5% wt/wt to magnesium gluconate as 0.05% wt/wt.

In one embodiment, the treatment composition has a pH greater than 11 and includes as a weight percent of the composition:

(a) about 0.1% wt/wt di- or tri-benzohydroxy compound;

(b) a strong base in an amount that provides the pH greater than 11;

(c) about 0.55% wt/wt divalent metal gluconate; and (d) balance water.

The pH is more preferably about 13. In all embodiments, the strong base can be a mixture of NaOH and KOH. In one embodiment, the NaOH is about 22% wt/wt and the KOH is about 20% wt/wt of the aqueous treatment composition.

In all embodiments, the di- or tri-benzohydroxy compound can be a mixture of pyrogallol and hydroquinone. In one embodiment, the pyrogallol is 0.1% wt/wt and the hydroquinone is 0.0002% wt/wt od the aqueous treatment composition. In all embodiments, the divalent metal gluconate can be a mixture of zinc gluconate and magnesium gluconate. In one embodiment, the zinc gluconate is 0.5% wt/wt and the magnesium gluconate is 0.05% wt/wt of the aqueous treatment composition.

Interestingly, the combination of the di- or tri-benzohydroxy compound and divalent metal gluconate is highly effective of oxidizing sulfides and mercaptans in the crude oil or petroleum distillate. We had trials where the levels of mercaptans were reduced by at least 50% in 3 hours and up to 99.9% in one hour depending on the dose of the aqueous treatment composition introduced into the crude oil or petroleum distillate. Hydrogen sulfide was reduced by 88% in the first half hour. Zinc is known to reduce quinone to hydroquinone. Zinc may also be catalyzing the oxidation of sulfides via a semiquinone radical. The oxidation of sulfides by hydroquinone is not thermodynamically favorable without a catalyst.

Our experiments started with a caustic solution in combination with hydroquinone and a zinc powder and then with flavin and zinc powder in a model solution spiked with a known concentration of pentanethiol to detect whether the mercaptan concentration was decreased. This was not effective in oxidizing a sufficient amount of the sulfur compounds. Moreover, it was difficult to keep zinc powder in solution. Zinc gluconate was tested as an alternative because it is purported to produce peroxy and hydroxy radicals in the presence of sulfides. The zinc gluconate performed better than zinc powder as shown in Table 1 below.

A few chelating examples were tried alone and in combination with hydroquinone and zinc powder, and variations thereof. A model chelating agent, EDTA, is known to stabilize hydrogen sulfide in solution which inhibits the oxidation process. However, hydroxy forms of ferric chelates (e.g., Fe-EDTA) are used to remove hydrogen sulfide from natural gas by oxidative absorption whereby hydrogen sulfide is oxidized to elemental sulfur. We found that the chelating agents tied up the zinc powder and made the performance worse.

In another aspect, methods of treating crude oil or petroleum distillates with the aqueous treatment compositions described above are described below. A crude oil or petroleum distillate in need of a reduced content of sulfur containing compounds is provided. An aqueous treatment composition. The crude oil or petroleum distillate is dosed with a preselected concentration of the aqueous treatment composition. The dose may be 1% wt/wt relative to the oil or less than 1% wt/wt. Doses in this range produced a reduction in mercaptan concentration of at least 50% in a few as 1 hour to 3 hours. A 1% wt/wt dose of the aqueous treatment composition produces a 64% reduction in total mercaptans in as few as 1 to 3 hours. A smaller quantity of the aqueous treatment composition, such as 0.1% by volume, was tested on different types of oil, and typically a 50% reduction in total mercaptans occurred over a 12-hour period. Thus, a higher dose of the aqueous treatment composition reacts faster and with a higher percent conversion of mercaptans to disulfides.

Since the aqueous treatment composition is water-based, the treatment process will add water to the oil. The solubility of water in oil depends on the viscosity and other characteristics of the oil. Once the water solubility of the oil is exceeded, the water will separate out. Typically, an addition of 0.1% of the aqueous treatment composition will not result in separation of the aqueous phase, but 1% addition will create a thin film of aqueous phase at the bottom of the oil.

The dosing can be done with or without stirring, but better results occurred with stirring. For example, it was found that a 1% wt/wt dose of the aqueous treatment composition, when left to sit without stirring for several hours, created layers within the oil, where a sample from the top has a much lower concentration of total mercaptans than a sample taken from the bottom of the oil sample. Moreover, when this "layered" sample was stirred again and then measured, the concentration of mercaptans was lower than the control crude oil sample. As such, oxidation and settling are both happening in the sample.

In one embodiment, the treated oil mixture comprises 0.001% to 0.02% wt di- or tri-benzohydroxy compound/wt oil and 0.001% to 0.03% wt divalent metal gluconate/wt oil. The presence of the di- or tri-benzohydroxy compound and divalent metal gluconates compound in the crude oil or petroleum distillate reduces the amount of sulfur compounds present therein. The sulfur compound can be hydrogen sulfide and/or one or more mercaptans. The crude oil or petroleum distillate is stirred for a pre-selected period of time, such as for at least one hour. In one embodiment, access to oxygen gas, such as in ambient air, is controlled by placing the crude oil or petroleum distillate in a sealed container with a selected amount of headspace containing ambient air. Oxygen in the headspace from air (autooxidation) and/or oxygen in water is available to react with sulfides to produce sulfates. Transition metal ions catalyze the oxidation of $H_2S$ and mercaptans. Water put through oil containing sulfides yielded sulfide, but after treatment with the above-described aqueous treatment compositions, the sulfide became sulfate and/or thiosulfate as well as sulfite ions ions according to infrared (IR) results and colorimetric methods (spectrophotometry) for identification of sulfide, sulfites, and sulfates.

In all aspects, the di- or tri-benzohydroxy compound is hydroquinone and/or pyrogallol, more preferably a mixture of hydroquinone and pyrogallol. The wt/wt concentration of pyrogallol is greater than the wt/wt concentration of hydroquinone. In all aspects, the divalent metal gluconate is zinc gluconate and/or magnesium gluconate, more preferably a mixture of zinc gluconate and magnesium gluconate. The wt/wt concentration of zinc gluconate is greater than the wt/wt concentration of magnesium gluconate.

The treatment method can also include the addition of pre-determined parts per million (ppm) concentration of a hydrogen peroxide aqueous solution. The hydrogen peroxide solution may be a 30% wt/wt solution or less, for example, a 10% wt/wt solution, a 2% wt/wt solution, or a 1% wt/wt solution. The hydrogen peroxide is added after mixing the aqueous treatment composition with the crude oil or petroleum distillate, generally at least 10 minutes after the treatment composition. In one embodiment, the hydrogen peroxide was added a half hour after the treatment composition. In another embodiment, the hydrogen peroxide was added an hour after the treatment composition.

The method can include a post-treatment washing of the oil mixture. The washing medium can be toluene, ozonated water, or a hydrogen peroxide solution (2% to 30% solution). Toluene reacts with the hydroxide in the aqueous treatment composition to form benzyl alcohol/aldehyde, thus excess caustic from over-dosing the product into the oil can be consumed by the addition of toluene to the oil. Ozonated water or the hydrogen peroxide solution can be introduced after the initial chemical reaction slows (typically after 3 hours) if a liquid-liquid extraction process is desired. Both reduce the total sulfur content in the oil. We had trials where the hydrogen peroxide aided in the oxidation mechanism of the mercaptans. But, we also had trials where the peroxide reacted with the divalent metal gluconate(s) to form a dimer that precipitates from the oil mixture. This can be beneficial in that the oil can be more easily removed, decanted, from the precipitate. We found that after stirring stopped, the gluconates (sugars) settled to the bottom of the oil, as a thin film. When hydrogen peroxide was added without stirring, it settled to the bottom and reacted with the gluconates to form the precipitate. Gluconate is stable at high pH but breaks down upon reacting with hydrogen sulfide (i.e., when hydrogen sulfide is oxidized). We have preliminarily identified a free radical mechanism with electron spin resonance spectroscopy.

The method may include removal of the water from the treated oil, the water being from the aqueous treatment composition. This can be accomplished by the addition of an emulsifying agent. One example is polyethylene glycol (PEG). The PEG can be added as about 1000 ppm or less. In one embodiment, PEG is added as 100 ppm. In another embodiment, PEG is added as 50 ppm.

To test for residual alkalinity, jar-testing of a small test sample is done by adding about 10% volume of water through the oil and determining the pH. If the pH is higher than 10, a small amount of toluene is added and left for several hours or overnight and the oil is jar-tested again. The resulting pH should be in a range of 9 to 10. If the wash water in a jar test has a pH above 10, it indicates unspent hydroxyl ions which can be corrosive in pipelines etc. When $H_2S$ and mercaptans are present in oil, water from a water wash of the oil was found to have a negative redox potential (e.g., −250 mV). Water put through the oil after treatment should optimally have a pH of about 9 and redox potential of about −100 mV to +25 mV.

WORKING EXAMPLES

The basic procedure used to form the aqueous treatment compositions used in the following examples is as follows: water was adjusted to a pre-selected pH by addition of concentrated potassium hydroxide and concentrated sodium hydroxide, the NaOH/KOH mixture can be a 1:1 mixture or about a 1.1:1 mixture, then the substance being tested as a treatment agent, such as hydroquinone, pyrogallol, zinc gluconate, magnesium gluconate, etc. were added thereto in amounts sufficient to provide the concentrations set forth in the tables in the examples below. Each solution was stirred for one hour with a controlled amount of headspace in a covered vessel.

After preparation of the test solutions per the above procedure, oil samples were prepared, typically as 100 mL samples. The oil samples used in the Examples herein contained mercaptans, such as ethanethiol, butanethiol, and pentanethiol. Testing revealed that pentanethiol was the easiest to detect and measure. Mass spectrometry analysis evidenced a disulfide product of pentanethiol and other possible products (various peaks appeared on the chromatograms as the peak for pentanethiol decreased) after treatment with the aqueous treatment composition.

Each aqueous treatment composition was added to a respective oil sample as a dose amount. In most examples, the aqueous treatment composition was dosed in the amount of 1% by volume (1 mL pipetted into 100 mL of oil). The oil with aqueous treatment composition was stirred for at least one hour, then sampled for mercaptans using the standard ASTM UOP 163 potentiometric titration method. The lower limit of quantitation for UOP 163 is 0.2 mass-ppm mercaptan (as sulfur) and 1.0 mass-ppm hydrogen sulfide (as sulfur). The dose can be varied and if the dose was other than 1%, it is specified in the Examples below. The period of stirring can be extended as well and if greater than one hour is indicated in the Examples below as well.

Example 1

A sample of crude oil was obtained and tested in 100 ml samples according to varying treatment possibilities. Each sample of crude oil was spiked with 100 ppm of pentanethiol to establish a known baseline against which to measure the decrease in the amount of mercaptan. The ppm pentanethiol in this example are measured using the titration method described above. An unspiked control sample had 48 ppm pentanethiol after a one-hour incubation period (time allotted for the chemical reaction to proceed before analysis of a sample). A spiked control sample had 233 ppm pentanethiol after a one-hour at room temperature and pressure. The samples were allowed to react at room temperature and pressure in a sealed container (such as with a screw cap lid secured on the reaction vessel) with stirring using a magnetic stirring plate at a moderate rate (e.g., 500-1000 rpm) for a pre-selected period of time. The containers had limited headspace, approximately twenty percent headspace in some examples. As such, ambient air can initially contact the oil when the oil poured or during addition of the aqueous treatment composition, but since the container is sealed, air (a source of oxygen gas) introduction to the oil is limited and evaporation (volatilization) of the mercaptans out of the sample is minimized.

The pH listed in the tables in all the examples is the pH of the aqueous treatment composition itself, not the pH of the oil aqueous treatment composition mixture.

TABLE 1

| Trial | Treatment Composition (aqueous) | Concentration (% wt/wt oil) | pH (adjusted with 50:50 NaOH/KOH) | Reaction time | Pentanethiol (ppm) |
|---|---|---|---|---|---|
| | Control | 100 | — | 1 hr | 233 |
| 1 | zinc powder | 0.5 | 13 | 1 hr | 190 |
| 2 | zinc powder | 0.0001 | 13 | 1 hr | 44 |
| | hydroquinone | 0.001 | | 72 hr | 32 |
| 3 | zinc gluconate | 0.0001 | 13 | 3 hr | 34 |
| | hydroquinone | 0.0125 | | 72 hr | lower than detection limit |
| 4 | pyrogallol | 0.01 | 13 | 1 hr | 239 |
| 5 | hydroquinone | 0.0125 | 13 | 1.5 hr | 36 |
| | zinc gluconate | 0.018 | | 12 hr | lower than detection limit |
| 6 | hydroquinone | 0.0125 | 11 | 1 hr | 63 |
| | zinc gluconate | 0.018 | | | |
| 7 | hydroquinone | 0.0125 | 12 | 1 hr | 60 |
| | zinc gluconate | 0.018 | | | |
| 8 | hydroquinone | 0.0125 | 13 | 1.25 hr | 41 |
| | zinc gluconate | 0.018 | | | |
| 9 | hydroquinone | 0.0125 | 13 | 1 hr | 100 |
| | zinc gluconate | 0.018 | | | |
| 10 | hydroquinone | 0.0125 | 13 | 2 hr | 50 |
| | zinc gluconate | 0.018 | | | |
| 11 | hydroquinone | 0.0125 | 14 | 1 hr | lower than detection limit |
| | zinc gluconate | 0.018 | | | |

Trial 5 was duplicated two more times for the 12-hour detection period. The ppm of pentanethiol was again below detection limits in one of the trials and was 9 ppm in the other. Each pH level successfully reduced the ppm of pentanethiol, and the reduction increased as the pH increased. As seen in Trial 4, pyrogallol (tri-hydroxy benzene) alone did not oxidize the mercaptans.

Referring to FIG. 1, the aqueous treatment composition had NaOH/KOH in a concentration sufficient to define the pH of the solution (11, 12, 13, and 14, respectively), a zinc gluconate concentration of 0.1% wt/wt solution and a 1,4-benzenediol concentration of 0.05% wt/wt. The % removal of mercaptans at each pH is presented in FIG. 1. As the pH increased, so did the percent of the mercaptan removed.

Example 2

Pyrogallol was explored further. The control oil is spiked with 100 ppm pentanethiol, and then tested using the standard titration method.

TABLE 2

| Trial | Treatment | Concentration (% wt/wt oil) | pH adjusted with 50:50 NaOH/KOH | Reaction time | Pentanethiol (ppm) |
|---|---|---|---|---|---|
| | Control | 100 | — | 12 hr | 86 ppm |
| 12 | Pyrogallol | 0.001 | 13 | 12 hr | 66 ppm |
| | zinc gluconate | 0.015 | | | |
| 13 | Pyrogallol | 0.001 | 13 | 12 hr | 6 ppm |
| | zinc gluconate | 0.015 | | | |
| | $H_2O_2$ | 0.01 | | | |

The pyrogallol by itself in high pH aqueous solution was not effective, as seen in Trial 4 in Table 1 above. Pyrogallol with zinc gluconate did reduce the concentration of pentanethiol present in the oil sample as seen in Trial 12. There was a 25% reduction in pentanethiol. This is far less effective as compared to hydroquinone trials in Table 1. However, pyrogallol stays in solution better than hydroquinone at the above-tested concentrations. We have found it necessary to filter solutions containing hydroquinone to prevent precipitation.

TABLE 3

| Trial | Treatment | Concentration (% wt/wt oil) | pH adjusted with NaOH/KOH | Reaction time | Pentanethiol (ppm) |
|---|---|---|---|---|---|
| | Control | 100 | — | 1 hr | 156 ppm |
| 14 | zinc gluconate | 0.01 | 13 | 1 hr | 50 ppm |
| | | | | 2 hr | 40 ppm |
| 15 | zinc gluconate | 0.005 | 13 | 2 hr | 22 ppm |
| | hydroquinone | 0.001 | | | |
| 16 | zinc gluconate | 0.006 | 13 | 12 hr | 17 ppm |
| | hydroquinone | 0.001 | | | |

Each of Trial 14-16 successfully reduced the pentanethiol present. Zinc gluconate alone reduced the mercaptans ppm concentration by 68% in one hour and by 74% in two hours. With the addition of hydroquinone to the zinc gluconate, the mercaptans were oxidized further, by 86% in two hours and by 89% in 12 hours.

Example 4

Testing Magnesium Gluconate. Magnesium gluconate was considered as a substitute for zinc gluconate; however, the solubility of magnesium gluconate is low. The control in the table below was an unspiked, raw crude oil sample.

TABLE 4

| Trial | Treatment | Concentration (% wt/wt oil) | pH adjusted with NaOH/KOH | Reaction time | Mercaptan (ppm) |
|---|---|---|---|---|---|
| | Control 1 | 100 | — | — | 480 ppm |
| 17 | zinc gluconate | 0.0015 | 13 | 72 hr | 320 ppm |
| | magnesium gluconate | 0.0004 | | | |
| | pyrogallol | 0.0007 | | | |
| | hydroquinone | trace | | | |
| 18 | zinc gluconate | 0.0015 | 13 | 2 hr | None detected |
| | magnesium gluconate | 0.0004 | | | |
| | pyrogallol | 0.0007 | | | |
| | hydroquinone | trace | | | |
| | $H_2O_2$ | 0.015 | | | |

In testing the post-treatment addition of hydrogen peroxide, a 2% solution was not strong enough. We used a 30% solution of hydrogen peroxide in Trial 11 above. Hydrogen peroxide is not mixed into the treatment composition because it can undergo an exothermic reaction that is undesirable. Instead, as described above, the hydrogen peroxide is added after the aqueous treatment composition has been mixed into the oil for the incubation period.

A trace amount of hydroquinone in the above trial was 2 ppm. The aqueous treatment composition alone was effective in reducing the mercaptan concentration by 33%. This same treatment composition followed with an addition of 150 ppm of 30% hydrogen peroxide solution had no detectable mercaptans.

Example 3

Next trials were conducted to test the zinc gluconate. A sample of crude oil as tested in Example 1 to have a background amount of pentanethiol of 48 ppm was spiked with 100 ppm of pentanethiol. This is the control set forth in Table 2 below.

Trial 17 was repeated with a sample spiked with 10 ppm pentanethiol and followed by addition of 150 ppm hydrogen peroxide. There was no significant improvement in the reduction of the mercaptan concentration. Magnesium gluconate was added to the treatment composition.

TABLE 5

| Trial | Treatment | Concentration (% wt/wt oil) | pH adjusted with 50:50 NaOH/KOH | Reaction time | Mercaptan (ppm) |
|---|---|---|---|---|---|
| 19 | zinc gluconate | 0.0015 | 13 | 72 hr | 320 ppm |
| | pyrogallol | 0.0007 | | | |
| | hydroquinone | trace | | | |
| | $H_2O_2$ (30% sln) | 0.015 | | | |
| 20 | zinc gluconate | 0.0015 | 13 | 2 hr | 219 ppm |
| | magnesium gluconate | 0.0004 | | | |
| | pyrogallol | 0.0007 | | | |
| | hydroquinone | trace | | | |

Even without the hydrogen peroxide addition, the aqueous treatment composition having both the zinc gluconate and the magnesium gluconate performed better in the reduction of the mercaptans present in the crude oil sample. The myriad trial conducted revealed that magnesium gluconate is suitable in the aqueous treatment composition. And surprisingly, the inclusion of magnesium gluconate with zinc gluconate improved the efficacy of the reduction of mercaptans in the samples.

Calcium lactate, zinc-2-deoxyglucose, zinc acetate, and an organic copper compound (copper citrate) were each tested as possible alternatives to zinc gluconate and magnesium gluconate, but none were successful. The dose in oil for each substitute for zinc-gluconate was 0.0015%; pyrogallol was 0.0007% and hydroquinone 0.00001%, the pH of each solution was adjusted to 13, and the reaction time was 1 hour.

Example 5

Next, we increased the spike amount of the pentanethiol and tested the formulation of Trial 20 again.

TABLE 6

| Trial | Treatment | Concentration (% wt/wt oil) | pH adjusted with 50:50 NaOH/KOH | Incubation time | Mercaptan (ppm) |
|---|---|---|---|---|---|
| | Control | spiked 100 μL pentanethiol | | | 2460 ppm |
| 21 | zinc gluconate | 0.0015 | 13 | 72 hr | 353 ppm |
| | Mg-gluconate | 0.0004 | | | |
| | pyrogallol | 0.0007 | | | |
| | hydro-quinone | trace | | | |

The aqueous treatment composition was effective. It reduced the spiked pentanethiol concentration by about 86%.

Example 6

Make Aqueous Treatment Composition. To a blend of 22% (wt/wt) of sodium hydroxide and 20% (wt/wt) of potassium hydroxide, pyrogallol was added to a final concentration of 0.1% (wt/wt). The blend was stirred to homogeneity. Then, zinc gluconate was added to a concentration of 0.5% (wt/wt), followed by magnesium gluconate to 0.05% (magnesium gluconate is less water soluble than zinc gluconate, so it was added in lower quantity), followed by trace hydroquinone (2 ppm).

Treat crude Oil. An oil containing 32.6 ppm total mercaptans was obtained. The oil was analyzed by titration method, UOP 163. A one-liter aliquot (sample 1) of the oil was treated with 1000 ppm of the aqueous treatment composition with stirring. A second one-liter aliquot (sample 2) of the oil was treated with a dose of 500 ppm of the aqueous treatment composition with stirring. Both samples of oil were closed with a screw-cap lid before and after addition of the aqueous treatment composition. The samples were stirred at 500 rpm on a stir plate for two hours. The samples were removed from the stir plate thereafter and allowed to sit overnight (12 hours). The containers had approximately twenty percent headspace; this implies that ambient air can initially contact the oil when the oil is poured or during addition of the aqueous treatment composition, but since the container is then closed, there is not a continuous introduction of air into the oil, and there is minimal evaporation (volatilization) of mercaptans out of the sample.

After the 12-hour period, both samples were tested by titration according to the UOP 163 method. A control sample of the crude oil has 32.6 ppm mercaptans (naturally occurring, i.e., not spiked with additional mercaptans).

| | Dose to 1 L crude oil | Mercaptans (ppm) | % Mercaptans removed |
|---|---|---|---|
| Sample 1 | 1000 ppm | 13 ppm | 60% |
| Sample 2 | 500 ppm | 18 ppm | 45% |

Both samples significantly reduced the quantity of naturally occurring mercaptans present in crude oil.

Example 7: Gas Chromatography and Mass Spectrometer Analysis

We utilized headspace Gas Chromatography/Mass Spectrometry (GC/MS) selected ion monitoring (SIM) to monitor mercaptans in oil. The extraction was performed using solid phase microextraction fibers (SUPELCO® brand DVB/CAR/PDMS (Divinylbenzene/Carboxen/Polydimethylsiloxane). For quantification, a standard curve was generated using a pentanethiol standard across a range of concentrations using the SPME method, where each standard or sample contains a constant concentration of an internal standard. The response of pentanethiol is normalized to the response of the internal standard which is a quality assurance measure.

In this trial, pentanethiol was spiked into oil that had <5 ppm of naturally occurring pentanethiol. The total measured pentanethiol was quantified as 50 ppm. We have found that oil spiked with a mercaptan is easier to oxidize than naturally occurring mercaptans in oil, likely because the mercaptans are bound to or strongly associated with hydrocarbons in oil by hydrophobic interactions, Van Der Waals forces, etc.

TABLE 7

| Trial | Treatment | Concentration (% wt/wt oil) | pH adjusted with 50:50 NaOH/KOH | Incubation time | Pentanethiol spike | Pentanethiol (ppm) |
|---|---|---|---|---|---|---|
| | Control | 100 | — | 72 hr | 100 μL | 50 ppm |
| 22 | Zn-gluconate | 0.0015 | 13 | 72 hr | 10 μL | <LOQ |
| | Mg-gluconate | 0.00015 | | | | |
| | hydroquinone | trace | | | 100 uL | <LOQ |
| | pyrogallol | 0.0007 | | | | |

LOQ stands for "limit of quantification." For the test method used the LOQ was 1 ppm.

Example 8

Testing addition of PEG post treatment. An oil sample containing mercaptans was treated as above with 1% by volume (1 mL/100 mL of oil) of the aqueous treatment composition according to Trial 18. Then 0.1% by volume of 50 ppm polyethylene glycol was added one half hour after the above chemical blend was added. Titration using the UOP 163 titration method evidenced a 71% reduction in mercaptans in the oil from this treatment process. There was a thin film of aqueous phase found on the bottom of the oil that had separated. Polyethylene glycol at 50 ppm acts as a demulsifier which aids in the separation of the aqueous phase from the oil. The oil was then washed with water (approximately 50% wt/wt water: oil). Then, the oil phase and the water phase were each tested for total sulfur by X-ray diffraction. There was an additional loss of 20% sulfur out of the oil into the water wash.

It should be noted that the embodiments are not limited in their application or use to the details of construction and steps described herein. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention. In short, it is the Applicants' intention that the scope of the patent issuing herefrom be limited only by the scope of the appended claims.

What is claimed is:

1. A treatment composition for crude oil and/or petroleum distillates comprising:

about 0.05% to about 1% wt/wt di- or tri-benzohydroxy compound;

a mixture of sodium hydroxide and/or potassium hydroxide;

about 0.1% to about 1% wt/wt divalent metal gluconate or metallic zinc powder; and balance water;

wherein the treatment composition has a pH of 11 or greater.

2. The treatment composition of claim 1, wherein the di- or tri-benzohydroxy compound comprises hydroquinone and/or pyrogallol.

3. The treatment composition of claim 2, wherein the di- or tri-benzohydroxy compound comprises a mixture of hydroquinone and pyrogallol.

4. The treatment composition of claim 3, wherein the pyrogallol has percent wt/wt concentration greater than the percent wt/wt of the hydroquinone.

5. The treatment composition of claim 4, wherein the percent wt/wt of the pyrogallol is at least 500 times greater than the percent wt/wt of the hydroquinone.

6. The treatment composition of claim 1, wherein the treatment composition comprises about 0.05% to about 0.5% wt/wt di- or tri-benzohydroxy compound.

7. The treatment composition of claim 1, wherein the treatment composition comprises the divalent metal gluconate.

8. The treatment composition of claim 7, wherein the divalent metal gluconate is selected from the group consisting of zinc gluconate, magnesium gluconate, calcium gluconate, iron (II) gluconate, copper (II) gluconate and combinations thereof.

9. The treatment composition of claim 7, wherein the divalent metal gluconate is present as about 0.1% to about 0.8% wt/wt.

10. The treatment composition of claim 7, wherein the divalent metal gluconate is present as about 0.1% to about 0.6% wt/wt.

11. The treatment composition of claim 7, wherein the divalent metal gluconate comprises zinc gluconate and/or magnesium gluconate.

12. The treatment composition of claim 11, wherein the divalent metal gluconate comprises a mixture of zinc gluconate and magnesium gluconate.

13. The treatment composition of claim 12, wherein the zinc gluconate has a percent wt/wt concentration that is greater than the percent wt/wt of magnesium gluconate.

14. The treatment composition of claim 13, wherein the percent wt/wt of zinc gluconate is about 10 times greater than the percent wt/wt of magnesium gluconate.

15. The treatment composition of claim 1, wherein the pH is equal to or greater than the second pKa of hydrogen sulfide.

16. The treatment composition of claim 1, wherein the treatment composition comprises a mixture of sodium hydroxide and potassium hydroxide.

17. The treatment composition of claim 16, wherein the mixture of sodium hydroxide and potassium hydroxide is present as about a 1:1 ratio by percent weight.

18. The treatment composition of claim 1, wherein the treatment composition comprises about 0.05% to about 0.2% wt/wt di- or tri-benzohydroxy compound.

* * * * *